US006872130B1

(12) United States Patent
Zuniga

(10) Patent No.: US 6,872,130 B1
(45) Date of Patent: Mar. 29, 2005

(54) CARRIER HEAD WITH NON-CONTACT RETAINER

(75) Inventor: Steven M. Zuniga, Soquel, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 10/327,430

(22) Filed: Dec. 20, 2002

Related U.S. Application Data

(60) Provisional application No. 60/344,412, filed on Dec. 28, 2001.

(51) Int. Cl.[7] ..... B24B 29/00

(52) U.S. Cl. ..... 451/287; 451/398

(58) Field of Search ..... 451/285, 286, 451/287, 288, 289, 388, 397, 398

(56) References Cited

U.S. PATENT DOCUMENTS

| | | | | |
|---|---|---|---|---|
| 4,918,869 | A | | 4/1990 | Kitta |
| 5,205,082 | A | | 4/1993 | Shendon et al. |
| 5,398,459 | A | | 3/1995 | Okumura et al. |
| 5,423,558 | A | | 6/1995 | Koeth et al. |
| 5,423,716 | A | | 6/1995 | Strasbaugh |
| 5,527,209 | A | | 6/1996 | Volodarsky et al. |
| 5,584,751 | A | | 12/1996 | Kobayashi et al. |
| 5,605,488 | A | | 2/1997 | Ohashi et al. |
| 5,624,299 | A | | 4/1997 | Shendon |
| 5,643,053 | A | | 7/1997 | Shendon |
| 5,643,061 | A | | 7/1997 | Jackson et al. |
| 5,695,392 | A | | 12/1997 | Kim |
| 5,720,845 | A | | 2/1998 | Liu |
| 5,733,182 | A | | 3/1998 | Muramatsu et al. |
| 5,762,539 | A | | 6/1998 | Nakashiba et al. |
| 5,803,799 | A | | 9/1998 | Volodarsky et al. |
| 5,851,140 | A | | 12/1998 | Barns et al. |
| 5,879,220 | A | | 3/1999 | Hasegawa et al. |
| 6,110,025 | A | * | 8/2000 | Williams et al. ..... 451/286 |
| 6,132,298 | A | | 10/2000 | Zuniga et al. |
| 6,350,346 | B1 | | 2/2002 | Nakashiba et al. |
| 6,592,437 | B1 | * | 7/2003 | Boyd et al. ..... 451/285 |
| 6,648,739 | B2 | * | 11/2003 | Izumi et al. ..... 451/286 |

* cited by examiner

*Primary Examiner*—Dung Van Nguyen
(74) *Attorney, Agent, or Firm*—Fish & Richardson

(57) ABSTRACT

A carrier head for chemical mechanical polishing of a substrate has a base and a retaining ring positioned beneath the base. The retaining ring includes a main portion with a first surface to apply a load to a perimeter portion of the back surface of the substrate and an annular projection with a second surface to retain the substrate. A bottom surface of the projection is separated from a top surface of a polishing pad by a gap.

26 Claims, 3 Drawing Sheets

CARRIER HEAD WITH NON-CONTACT RETAINER

CROSS-REFERENCE TO RELATED APPLICATIONS

This application claim priority to U.S. Provisional Application Ser. No. 60/344,412, filed on Dec. 28, 2001.

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad. In general, uneven load distribution results in a non-uniform material removal and, consequently, in non-uniformity on the substrate surface.

A reoccurring problem in CMP is the so-called "edge effect", i.e., the tendency of the substrate edge to be polished at a different rate than the substrate center. The edge effect typically results in overpolishing (the removal of too much material from the substrate) at the substrate perimeter, e.g., the outermost five to ten millimeters of a 200-millimeter (mm) wafer. Unfortunately, some methods used to minimize the effects of "overpolishing" by controlling the pressure applied to the perimeter of substrate do not completely eliminate the edge effect.

Another problem is that the polishing pad contacts and abrades the bottom surface of the retaining ring. Eventually, the bottom surface of the retaining ring will be sufficiently worn that the retaining ring must be replaced. In addition, as the retaining ring wears, debris from the retaining ring can damage the substrate.

SUMMARY

In one aspect, the invention is directed to a carrier head for chemical mechanical polishing of a substrate having a front surface, a back surface and an edge. The carrier head has a base and a retaining ring positioned beneath the base. The retaining ring includes a main portion with a first surface to apply a load to a perimeter portion of the back surface of the substrate and an annular projection with a second surface to retain the substrate. A bottom surface of the projection is separated from a top surface of a polishing pad by a gap.

Implementations of the invention may include one or more of the following features. The projection may extend downwardly from the main portion. The second surface may circumferentially surround the edge of the substrate.

In another aspect, the invention is directed to a carrier head for chemical mechanical polishing of a substrate having a front surface, a back surface and an edge. The carrier head has a base, a first flexible membrane extending beneath the base to define at least a portion of a first pressurizable chamber, and a retaining ring positioned beneath the base. A lower surface of the first flexible membrane provides a first surface to apply a first load to a center portion of the back surface of the substrate. The retaining ring includes a main portion with a second surface to apply a second load to a perimeter portion of the back surface of the substrate and an annular projection protruding downwardly from the main portion with a third surface to circumferentially surround the edge of the substrate to retain the substrate.

Implementations of the invention may include one or more of the following features. A bottom surface of the lower projection may be separated from a top surface of a polishing pad by a gap. A housing portion may be secured to a drive shaft, and the base may be joined to the housing. The retaining ring may be vertically movable relative to the base. The base may include a flange which circumferentially surrounds the retaining ring. A second pressurizable chamber may be located between a top surface at the retaining ring and the base. Pressurization of the second pressurizable chamber may apply a downward second load to the retaining ring. The base may be movably connected to a housing by a second flexible membrane. The retaining ring may be fixed to the base. A volume between the base and the housing defined by the second flexible membrane may form a second pressurizable chamber. Pressurization of the second pressurizable chamber may apply a download pressure to the retaining ring. The first flexible membrane may further comprise a perimeter portion and a rim portion. The rim portion of the first flexible membrane may have a thickness greater than the perimeter portion. A rim portion of the first flexible membrane may be clamped between the housing and the base.

In another aspect, the invention is directed to a carrier head for chemical mechanical polishing of a substrate having a front surface, a back surface and an edge. The invention includes a base, a retaining ring positioned beneath the base and a flexible membrane defining a pressurizable chamber between the base and the retaining ring. The retaining ring includes a main portion with a first surface to apply a first load to a perimeter portion of the back surface of the substrate and an annular projection protruding downwardly from the main portion with a second surface to circumferentially surround the edge of the substrate to retain the substrate. The chamber is configured to apply a downward force on the retaining ring and the edge of the substrate when pressurized. A bottom surface of the retaining ring is separated from a top surface of a polishing pad by a gap.

In another aspect, the invention is directed to a carrier head for chemical mechanical polishing of a substrate having a front surface, a back surface and an edge. The carrier head has a base, a housing, a first flexible membrane extending beneath the base to define at least a portion of a first pressurizable chamber, and a retaining ring positioned beneath the base. A lower surface of the first flexible membrane provides a first surface to apply a first load to a center portion of the back surface of the substrate. The retaining ring includes a main portion with a second surface to apply a second load to a perimeter portion of the back surface of the substrate and an annular lower projection with a third surface to retain the substrate. A bottom surface of the retaining ring is separated from a top surface of a polishing pad by a gap. A second flexible membrane movably connects the base and the housing and defines a second pressurizable chamber to apply a second load to a retaining ring.

Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 1:
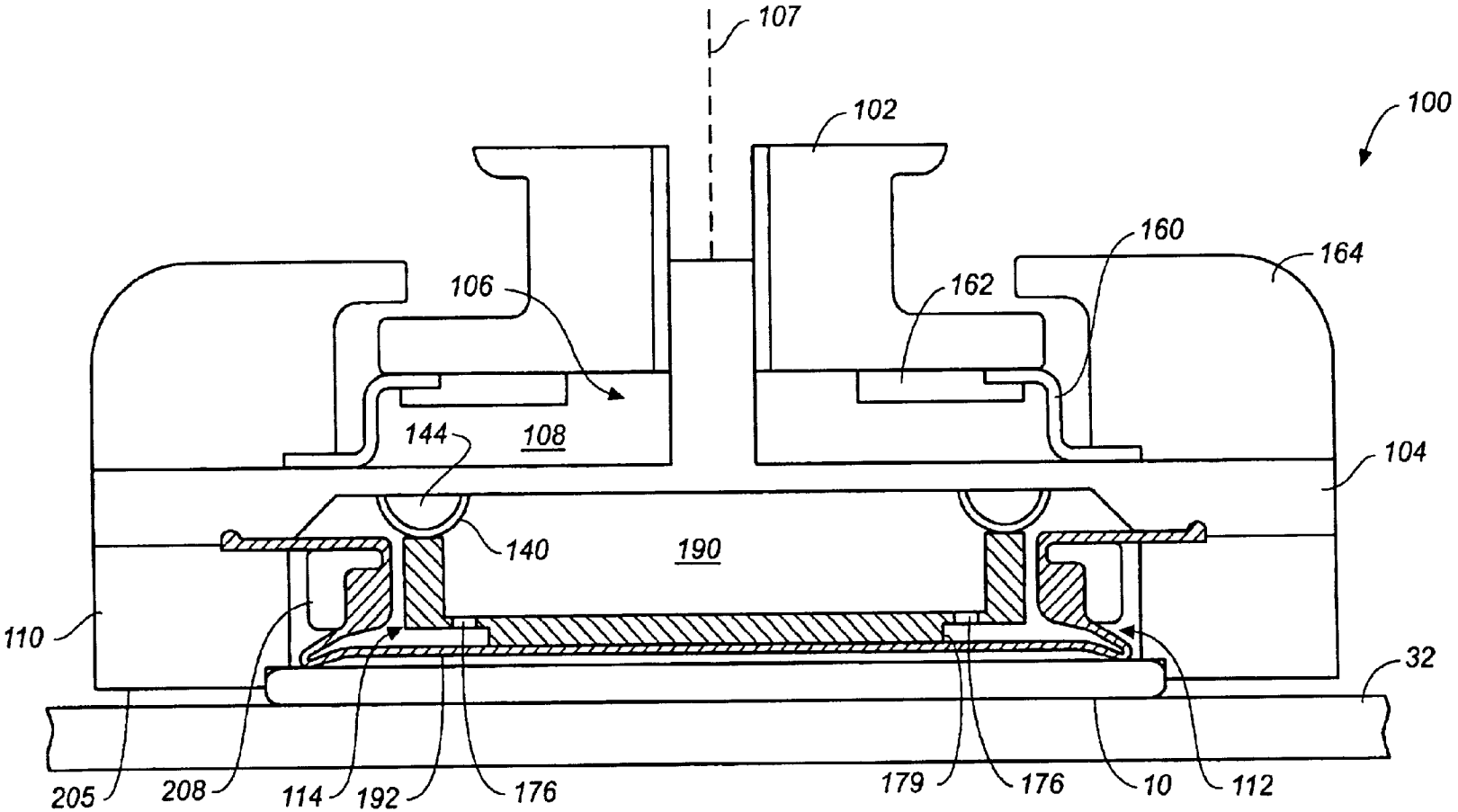
FIG. 1 is a schematic cross-sectional view of an implementation of a carrier head in which a retaining ring is secured to a base.

Referring to FIG. 1, a substrate 10 will be polished by a chemical mechanical polishing (CMP) apparatus that has a carrier head 100. A description of a suitable CMP apparatus may be found in U.S. Pat. No. 5,738,574, the entire disclosure of which is hereby incorporated by reference.

Figure 2:
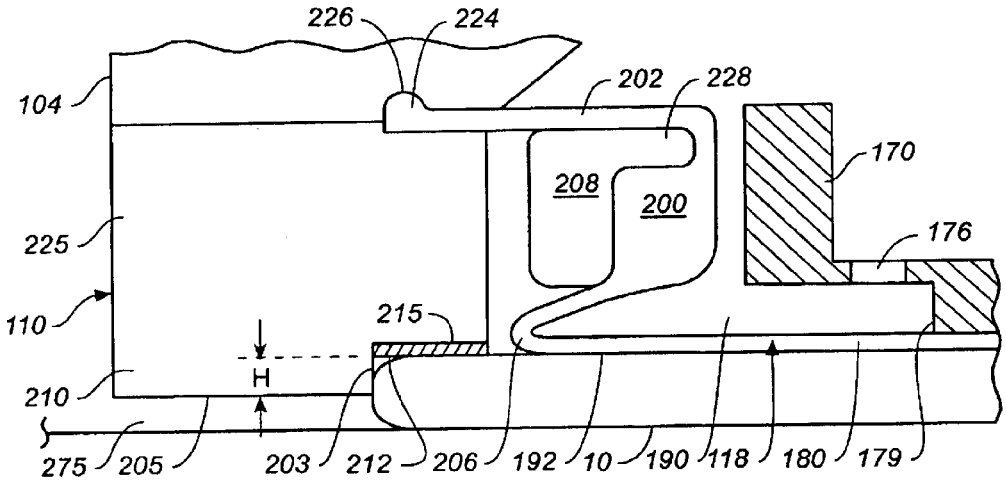
FIG. 2 is an expanded view of the retaining ring from the carrier head of FIG. 1.

Referring to FIGS. 1 and 2, carrier head 100 includes a housing 102, a base 104, a gimbal mechanism 106 (which can be considered part of the base 104), a loading chamber 108, a retaining ring 110, and a substrate backing assembly 112. A description of a similar carrier head may be found in U.S. Pat. No. 6,183,354, the entire disclosure of which is incorporated herein by reference.

The housing 102 can be connected to a drive shaft to rotate therewith during polishing about an axis of rotation 107 which is substantially perpendicular to the surface of the polishing pad during polishing. The loading chamber 108 is located between the housing 102 and the base 104 to apply a load, i.e., a downward pressure, to the base 104. The vertical position of the base 104 relative to the polishing pad 32 is also controlled by the loading chamber 108. A first pump (not shown) may be fluidly connected to the loading chamber 108 to control the pressure in the loading chamber 108 and the load applied to the base 104 and the retaining ring 110.

The housing 102 may be generally circular in shape to correspond to the circular configuration of the substrate to be polished. The base 104 is a generally ring-shaped body formed of a rigid material and is located beneath the housing 102. Unillustrated passages through the housing and the base provide pneumatic control of the carrier head. The gimbal mechanism 106 permits the base 104 to pivot with respect to the housing 102 so that the base may remain substantially parallel with the surface of the polishing pad.

An inner edge of a generally ring-shaped rolling diaphragm 160 may be clamped to the housing 102 by an inner clamp ring 162. An outer clamp ring 164 may clamp an outer edge of the rolling diaphragm 160 to the base 104. Thus, the rolling diaphragm 160 seals the space between the housing 102 and the base 104 to define the loading chamber 108.

An elastic and flexible membrane 140 may be attached to the lower surface of base 104 to define a bladder 144. A second pump (not shown) may be connected to the bladder 144 to direct a fluid, e.g., a gas, such as air, into or out of the bladder and thereby control a downward pressure on the support structure 114. Specifically, the bladder 144 may be used to cause a projection 179 (see FIG. 2) from a support plate 170 of the support structure 114 to press a central area of the flexible membrane 118 against substrate 10, thereby applying additional pressure to the central portion of the substrate.

The substrate backing assembly 112 includes a support structure 114, a flexible member or membrane 118 connected to the support structure 114, and a spacer ring 208. The flexible membrane 118 extends below the support structure 114 to provide a mounting surface 192 for the substrate. The sealed volume between the flexible membrane 118 and the base 104 defines a pressurizable chamber 190. Pressurization of the chamber 190 forces the flexible membrane 118 downwardly to press the substrate against the polishing pad 32. A third pump (not shown) may be fluidly connected to the chamber 190 to control the pressure in the chamber and thus the downward force of the flexible membrane on the substrate.

The support structure 114 includes a generally disk-shaped rigid support plate 170 member having a plurality of apertures 176 formed therethrough. The projection 179 may extend downwardly from a central region of the bottom surface of the support plate. The support plate 170 may not include apertures through the area above projection 179. Alternately, the apertures may extend through both the support plate and the projection.

The flexible membrane 118 has an inner portion 180, an expandable peripheral lip portion 206 to contact a perimeter portion of the substrate, an annular edge portion 200 that extends around the edges of the support plate 170, and a wing portion 202 that extends radially outward from the edge portion 200 to be secured between the retaining ring 110 and the base 104. The flexible membrane 118 can terminate in a thick rim portion 224 which fits into an annular recess 226 in the base 104. When the retaining ring 110 is secured to the base 104, the rim portion 224 is clamped between the base 104 and the retaining ring 110 to form a fluid-tight seal. The expandable lip portion 206 functions as described in U.S. Pat. No. 6,210,255, the entire disclosure of which is incorporated herein by reference.

The spacer ring 208 includes an inwardly-extending flange 228 that extends into a gap between the wing portion 202 and the edge portion 200. The spacer ring generally surrounds the edge portion 200 to maintain the structural integrity of the expandable lip portion 206 when the chamber 190 is pressurized.

The retaining ring 110 may be a generally annular ring secured at the outer edge of the base 104, e.g., by bolts. When fluid is pumped into the loading chamber 108 and the base 104 is pushed downwardly, the retaining ring 110 is also pushed downwardly. A bottom surface 205 of the retaining ring 110 may be substantially flat.

The retaining ring 110 includes a main portion 225 with a rigid surface 215 that applies pressure to a perimeter portion of the back surface of the substrate. A layer 212 of a high friction compressible material can be adhesively attached to the surface 215 of the main portion 225 to provide a mounting surface for the substrate.

The retaining ring also includes an annular projection 210 that protrudes downwardly from the main portion 225 below the surface 215 to form an annular recess in the inner, lower corner of the retaining ring 110. The projection 210 can have a cylindrical inner surface 203 that surrounds the substrate to prevent it from escaping from beneath the carrier head, and a substantially flat bottom surface 205 that is separated from the polishing pad 32 by a gap 275. The height H of the inner surface 203 should be greater than one-half of the substrate thickness, but should not exceed the total thickness of the substrate. Thus, when the retaining ring 110 sits on the substrate 10, the projection 210 extends sufficiently downwardly to retain the substrate without contacting the polishing pad 32.

When the loading chamber 108 is pressurized and the base 104 and retaining ring 110 are forced downwardly, the surface 212 exerts a downward pressure on the high friction layer 215. This downward pressure is transmitted through the layer 215 to the perimeter portion of the back surface of the substrate.

As previously discussed, one reoccurring problem in CMP is that the polishing pad contacts and abrades the bottom surface of the retaining ring. However, because the lower projection 210 of the retaining ring 110 does not contact the polishing pad 32, the retaining ring wear can be reduced or eliminated, and damage to the substrate from the polishing debris can be prevented. Consequently, the potential life span of the retaining ring can be increased, and scratching of the substrate can be decreased. Because the replacement of the retaining ring is a costly and time-consuming procedure, improving the retaining ring lifetime decreases the cost of ownership of the CMP apparatus.

The carrier head 100 also addresses another reoccurring problem in CMP, specifically the "edge effect". The flexible membrane 118 applies a first load from the chamber 190 to the central portion of the substrate, whereas the retaining ring 110 applies a second, independent load from the upper loading chamber 108 to the perimeter portion of the substrate through the high friction layer 215. Thus, different pressures can be selected for the center and edge of the substrate to compensate for polishing non-uniformity.

Figure 4:
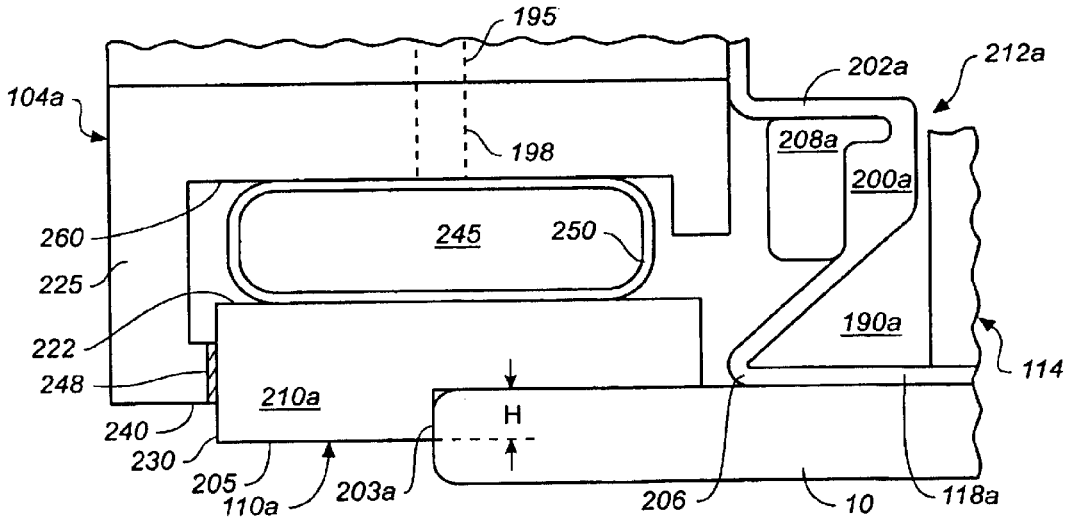
FIG. 4 is an expanded view of the retaining ring from the carrier head of FIG. 3.
Figure 3:
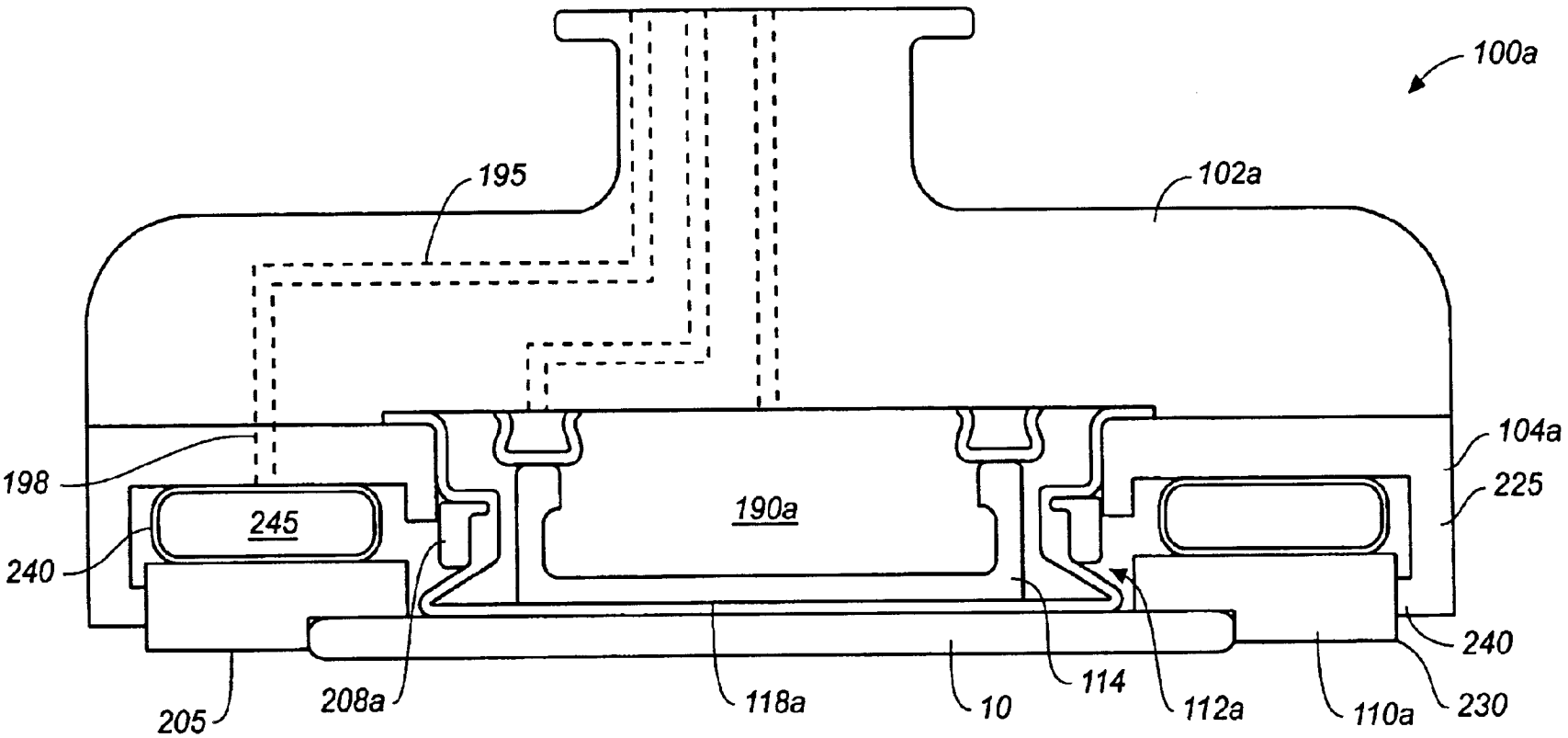
FIG. 3 is a schematic cross-sectional view of another implementation of a carrier head in which a retaining ring is movable relative to a base.

Referring to FIGS. 3 and 4, in another implementation, the carrier head 100*a* includes a housing 102*a*, a base 104*a*, a substrate backing assembly 112*a*, and a retaining ring 110*a*.

In contrast to the carrier head 100, the base 104*a* is secured to the housing 102*a*, rather than being vertically movable. Thus, in this implementation, the base 104*a* can be considered part of housing 102*a*. The housing 102*a* can have a passage 195 extending through it for pneumatic control of the load applied to the retaining ring 110*a*. This implementation need not include the gimbal mechanism, the loading chamber or the rolling diaphragm of the carrier head 100.

The base 104*a* is a generally ring-shaped member joined to the housing 102*a*, e.g., by bolts or screws. The-base piece 104*a* can have an annular projection 225 extending generally vertically downwardly from the main portion of the base. The projection 225 has a flange 240 which extends inwardly to contact the outer surface 230 of the retaining ring 110*a* and prevent lateral movement of the retaining ring 110*a*. An elastic bumper material 248 can be placed at the end of the flange 240 to prevent damage to the retaining ring 110*a*. A passage 198 can extend through the base 104*a* to fluidly connect with the passage 195 in the housing 102*a* with a pressure source, such as a pump.

The flexible membrane 118*a* of the substrate backing assembly 112*a* has generally the same structure as in the carrier head 100. The flexible membrane 118*a* includes an edge portion 200*a* that extends around the support structure 170, and a free span portion 202*a* that extends radially outwardly from the edge portion 200*a*, over the upper surface of a spacer ring 208*a*, to be clamped between the base 104*a* and the housing 102*a*. Alternatively, the outer edge of the free span portion 202*a* can be clamped or adhesively attached (as shown in FIG. 4) to an inner surface of the housing 102*a*. The sealed volume between the flexible membrane 118*a* and the base 104*a* defines a pressurizable chamber 190*a*. A first pump (not shown) may be fluidly connected to the chamber 190*a* to control the pressure in the chamber 190*a* and thus the downward force on the center portion of the substrate.

The retaining ring 110*a* serves the same purpose as the retaining ring in the carrier head 100, but is independently vertically movable relative to the base 104*a* and the housing 102*a*.

An elastic and flexible member 250 is secured to the bottom of the base 104*a*. The flexible member 250 defines a pressurizable annular bladder 245 which is positioned between the lower surface 260 of the base 104*a* and the top surface 222 of the retaining ring 110*a*. The pressurizable bladder 245 can be secured to the base 104*a* and to the retaining ring 110*a*. A second pump (not shown) can be connected to the bladder 245 by the passages 195 and 198 to direct a fluid, e.g., a gas, such as air, into or out of the bladder, and thereby control a downward pressure on the retaining ring.

When pressurized, the bladder 245 causes the projection 210*a* of the retaining ring 110*a* to move downwardly. The surface 212*a* is pressed against the substrate, and the inner surface 203*a* of the retaining ring surrounds the outer surface of the substrate. Because the flange 240 of the base 104*a* surrounds the retaining ring 110*a* and prevents it from lateral movement during polishing, this structure permits the retaining ring 110*a* to retain the substrate. Additionally, the pressure in the bladder 245 applies a load to the perimeter portion of the substrate. By independently adjusting the pressure on the substrate perimeter, polishing uniformity can be improved.

Also, because the height H of the inner surface 203*a* of the retaining ring 110*a* is greater than one-half of the substrate thickness, but does not exceed the entire thickness of the substrate, the lower projection 210*a* extends sufficiently downwardly to retain the substrate, but does not protrude below the bottom surface of the substrate. Therefore, when the bladder is pressurized during polishing, the retaining ring does not contact the polishing pad 32. Consequently, the retaining ring wear can be reduced or eliminated, and damage to the substrate from the polishing debris can be prevented.

The present invention has been described in terms of a number of embodiments. The invention, however, is not limited to the embodiments depicted and described. Rather, the scope of the invention is defined by the appended claims.

What is claimed is:

1. A carrier head for chemical mechanical polishing of a substrate having a front surface, a back surface and an edge, comprising:

a base;

an annular retaining ring positioned beneath the base and having a main portion with a first surface to apply a load to a perimeter portion of the back surface of the substrate and having an annular projection with a second surface to retain the substrate, wherein the retaining ring is configured such that a bottom surface of the projection is separated from a top surface of a polishing pad by a gap during polishing.

2. The carrier head of claim 1 wherein the projection extends downwardly from the main portion.

3. The carrier head of claim 2 wherein the second surface circumferentially surrounds the edge of the substrate.

4. A carrier head for chemical mechanical polishing of a substrate having a front surface, a back surface and an edge, comprising:

a base;

a first flexible membrane extending beneath the base to define at least a portion of a first pressurizable chamber, a lower surface of the first flexible membrane providing a first surface to apply a first load to a center portion of the back surface of the substrate; and a retaining ring positioned beneath the base and having a main portion with a second surface to apply a second load to a perimeter portion of the back surface of the substrate and having an annular projection protruding downwardly from the main portion with a third surface to circumferentially surround the edge of the substrate to retain the substrate wherein the retaining ring is configured such that a bottom surface of the projection is separated from a top surface of a polishing pad by a gap during polishing.

5. The carrier head of claim 4, further comprising a housing portion to be secured to a drive shaft, wherein the base is joined to the housing.

6. The carrier head of claim 5, wherein the retaining ring is vertically movable relative to the base.

7. The carrier head of claim 6, wherein the base includes a flange which circumferentially surrounds the retaining ring.

8. The carrier head of claim 4, further comprising a second pressurizable chamber between a top surface at the retaining ring and the base.

9. The carrier head of claim 8, wherein pressurization of the second pressurizable chamber applies a downward second load to the retaining ring.

10. A carrier head for chemical mechanical polishing of a substrate having a front surface, a back surface and an edge, comprising:

a base;

a first flexible membrane extending beneath the base to define at least a portion of a first pressurizable chamber, a lower surface of the first flexible membrane providing a first surface to apply a first load to a center portion of the back surface of the substrate;

a retaining ring positioned beneath the base and having a main portion with a second surface to apply a second load to a perimeter portion of the back surface of the substrate and having an annular projection protruding downwardly from the main portion with a third surface to circumferentially surround the edge of the substrate to retain the substrate; and a housing and a second flexible membrane, wherein the base is movably connected to the housing by the second flexible membrane.

11. The carrier head of claim 10, wherein the retaining ring is fixed to the base.

12. The carrier head of claim 11, wherein a volume between the base and the housing defined by the second flexible membrane forms a second pressurizable chamber.

13. The carrier head of claim 12, wherein pressurization of the second pressurizable chamber applies a download pressure to the retaining ring.

14. The carrier head of claim 13, wherein the first flexible membrane further comprises a perimeter portion and a rim portion.

15. The carrier head of claim 14, wherein the rim portion of the first flexible membrane has a thickness greater than the perimeter portion.

16. The carrier head of claim 14, wherein a rim portion of the first flexible membrane is clamped between the housing and the base.

17. A carrier head for chemical mechanical polishing of a substrate having a front surface, a back surface and an edge, comprising:

a base;

a retaining ring positioned beneath the base and having a main portion with a first surface to apply a first load to a perimeter portion of the back surface of the substrate and an annular lower projection protruding downwardly from the main portion with a second surface to circumferentially surround the edge of the substrate to retain the substrate; and a flexible membrane defining a pressurizable chamber between the base and the retaining ring, the chamber configured to apply a downward force on the retaining ring and the edge of the substrate when pressurized, wherein the retaining ring is configured such that a bottom surface of the retaining ring is separated from a top surface of a polishing pad by a gap during polishing.

18. A carrier head for chemical mechanical polishing of a substrate having a front surface, a back surface and an edge, comprising:

a base;

a housing;

a first flexible membrane extending beneath the base to define at least a portion of a first pressurizable chamber, a lower surface of the first flexible membrane providing a first surface to apply a first load to a center portion of the back surface of the substrate;

a retaining ring positioned beneath the base, the retaining ring including a main portion with a second surface to apply a second load to a perimeter portion of the back surface of the substrate and an annular lower projection with a third surface to retain the substrate, wherein the carrier head is configured such that during polishing a bottom surface of the retaining ring is separated from a top surface of a polishing pad by a gap; and a second flexible membrane movably connecting the base and the housing and defining a second pressurizable chamber to apply a second load to a retaining ring.

19. A carrier head for chemical mechanical polishing of a substrate having a front surface, a back surface and an edge, comprising:

a base;

a first load applying member extending beneath the base, a lower surface of the first load applying member providing a first surface to apply a first load to a center portion of the back surface of the substrate; and a second load applying member positioned beneath the base and having a main portion with a second surface to apply a second load to a perimeter portion of the back surface of the substrate and having an annular projection protruding downwardly from the main portion with a third surface to circumferentially surround the edge of the substrate to retain the substrate wherein the carrier head is configured such that a bottom surface of the projection is separated from a top surface of a polishing pad by a gap during polishing.

20. A method of polishing of a substrate having a front surface, a back surface and an edge, comprising:

holding a substrate with an inner diameter surface of an annular projection from a retaining ring without the retaining ring contacting the polishing pad, wherein the retaining ring includes a main portion with a first surface to contact a perimeter portion of a back surface of the substrate;

pressurizing a first chamber in a carrier head to press a center portion of the substrate against the polishing pad; and creating a relative motion between the substrate and the polishing pad to polish the substrate.

21. The method of claim 20, wherein:

pressurizing a first chamber includes pressing a membrane against a back surface of the substrate.

22. The method of claim 20, wherein:

holding a substrate including applying a first load to a perimeter portion of the back surface of the substrate;

pressurizing a first chamber includes applying a second load to the center portion of the back of the substrate; and the first load is not equal to the second load.

23. The method of claim 20, wherein:

pressurizing a first chamber includes pressurizing a chamber formed between a substrate support structure and a base, and the substrate support structure has a projection that applies pressure to the center portion of the back surface of the substrate.

24. The method of claim 20, further comprising:

pressurizing a second chamber located between a base and the retaining ring to move the retaining ring relative to the base.

25. The method of claim 20, wherein:

holding a substrate includes transferring pressure from the retaining ring through a high friction compressible material to the perimeter portion of the back surface of the substrate.

26. The method of claim 20, wherein:

holding a substrate includes applying a first load to an perimeter portion of the back surface of the substrate; of the carrier head pressurizing a first chamber includes pressurizing a chamber formed between a substrate support and a base, wherein the substrate support structure has a projection that applies a second load to the center portion of the back surface of the substrate; and pressurizing a first chamber includes pressurizing a chamber formed between a membrane and the base, such that a third load is applied to an inner annular portion of the back surface of the substrate.

* * * * *